US006708622B2

(12) United States Patent
Bergeron

(10) Patent No.: US 6,708,622 B2
(45) Date of Patent: Mar. 23, 2004

(54) RAIL MOUNTED PATIENT LIFT

(75) Inventor: Jean Bergeron, Canton Magog (CA)

(73) Assignee: Arjo. Med. Aktiebolag Limited, Gloucester (GB)

( * ) Notice: Subject to any disclaimer, the term of this patent is extended or adjusted under 35 U.S.C. 154(b) by 0 days.

(21) Appl. No.: 10/265,358

(22) Filed: Oct. 7, 2002

(65) Prior Publication Data

US 2003/0140816 A1 Jul. 31, 2003

(30) Foreign Application Priority Data

Oct. 9, 2001 (GB) ..... 0124199

(51) Int. Cl.[7] ..... A61G 7/00

(52) U.S. Cl. ..... 104/96; 104/100; 104/103; 104/89; 5/81.1 R

(58) Field of Search ..... 104/122, 96, 98, 104/100, 103, 93, 94, 95; 5/81.1 R, 85.1, 89.1, 81.1 C; 212/330, 284

(56) References Cited

U.S. PATENT DOCUMENTS 1,612,217 A * 12/1926 Phillips ..... 414/611
1,750,802 A * 3/1930 Haferkorn ..... 104/100
3,011,455 A * 12/1961 Heimann ..... 104/96
4,336,757 A * 6/1982 Toder ..... 104/102
5,490,293 A * 2/1996 Nilsson ..... 5/83.1

FOREIGN PATENT DOCUMENTS

| | | |
|---|---|---|
| DE | 81674 | 11/1894 |
| DE | 686995 | 1/1940 |
| DE | 2 315 453 | 10/1974 |
| DE | 91 09 343 | 11/1991 |

* cited by examiner

*Primary Examiner*—Mark T. Le
(74) *Attorney, Agent, or Firm*—Young & Thompson

(57) ABSTRACT

A rail mounted patient lift comprises a ceiling mountable rail 10, a carriage 16 mounted for displacement along the rail, a flexible elongate support element and power operated lifting means for extending and retracting the support element relative to the carriage. The rail 10 comprises a plurality of rail sections 10*a*, 10*b* which in use are suspended from a ceiling with a gap 13 therebetween at a position where the rail 10 is to cross the path of a curtain 14. Each rail section has at least one pivotable flap 19 engageable by the carriage 16 as it moves along the rail. The flap 19 of one of a pair of adjoining rail sections is pivotable by the carriage as it moves in one direction to bridge the gap between the two sections and the flap of the other of the pair of adjoining rail sections is pivotable by the carriage as it moves in an opposite direction to bridge the gap between the two rail sections.

5 Claims, 3 Drawing Sheets

RAIL MOUNTED PATIENT LIFT

INTRODUCTION

This invention relates to a rail mounted patient lift.

Rail mounted patient lifts are well known. One such lift is disclosed in EP-A-1090620. The known lifts comprise a ceiling mounted rail and a carriage mounted for displacement along the rail usually by power operated drive means on or within the carriage. The lifts also comprise a flexible elongate support element, usually having a sling hanger attached to its free end, and power operated lifting means for extending and retracting the support element relative to the carriage.

These patient lifts are regularly installed in hospital wards and the like. Curtains are also installed in hospital wards to give privacy to patients on the ward. There is a problem in providing cross overs between the path of the curtain and the path of a ceiling mounted patient lift.

SUMMARY OF THE INVENTION

According to the present invention there is provided a rail mounted patient lift comprising a ceiling mountable rail, a carriage mounted for displacement along the rail, a flexible elongate support element and power operated lifting means for extending and retracting the support element relative to the carriage, wherein the rail comprises a plurality of rail sections which in use are suspended from a ceiling with a gap therebetween at a position where the rail is to cross the path of a curtain and wherein each rail section has at least one pivotable flap engageable by the carriage as it moves along the rail, the flap of one of a pair of adjoining rail sections being pivotable by the carriage as it moves in one direction to bridge the gap between the two sections and the flap of the other of the pair of adjoining rail sections being pivotable by the carriage as it moves in an opposite direction to bridge the gap between the two rail sections.

The invention will now be more particularly described, by way of example, with reference to the accompanying drawings.

DESCRIPTION OF THE PREFERRED EMBODIMENTS

Figure 1:
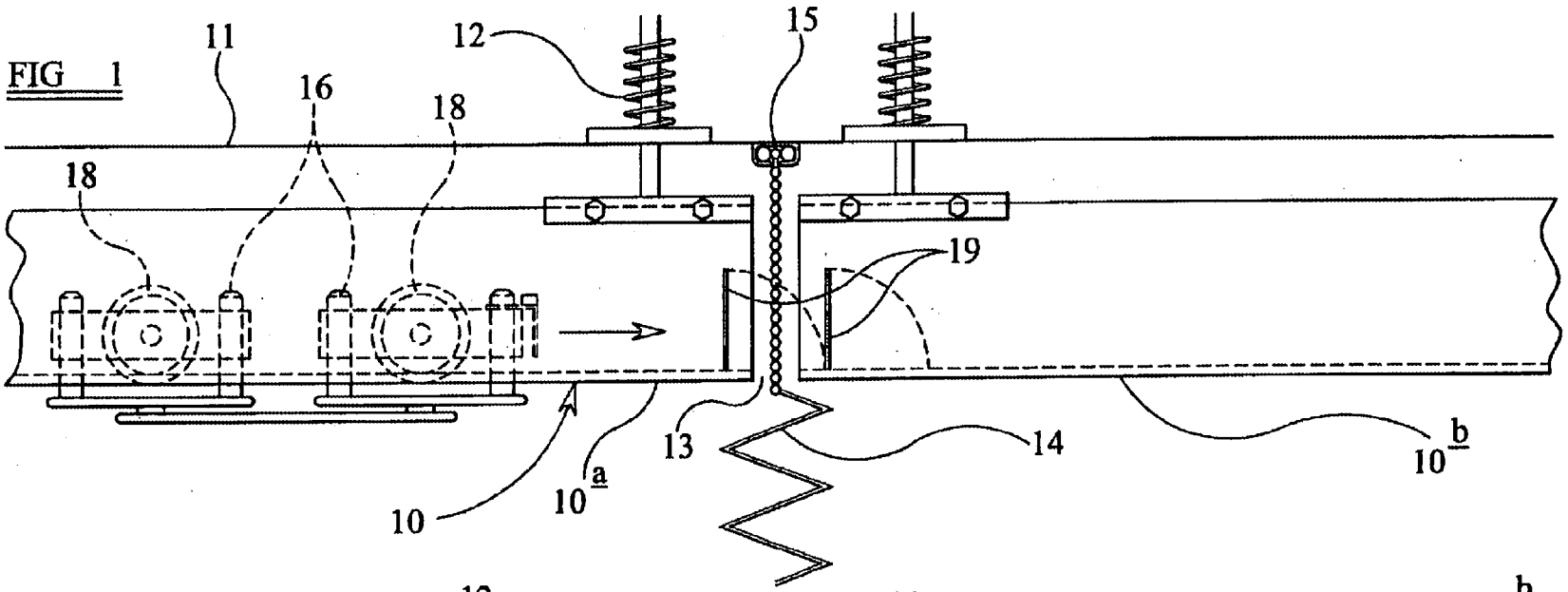
FIG. 1 is a schematic side view of one embodiment of rail mounted patient lift in a first condition of operation.

Referring to the drawings, there is shown a rail mounted patient lift comprising a rail 10 attached to a ceiling 11 by suspension connecting devices 12.

The rail comprises a plurality of sections, only two of which are shown at 10*a* and 10*b*. The rail sections are aligned longitudinally but have a small gap 13 between adjacent ends. The gap 13 is provided at a position where the rail 10 crosses the path of a curtain 14 suspended from a curtain track 15 attached directly to the ceiling 11. The curtain track 15 extends perpendicularly to the longitudinal extent of the rail 10. The curtain 14 can thus be drawn across the path of the rail 10 when the rail mounted patient lift is not in use.

The rail mounted patient lift also comprises one or more carriages 16 mounted for displacement along the rail 10 by power operated drive means on or within the carriage.

The rail 10 in cross section is of generally inverted U-shape with an in-turned flange 17 at the lower free end of each of the two vertical limbs of the rail 10. These in-turned flanges 17 define two spaced apart parallel track portions for guiding the carriage 16 along the rail.

Figure 4:
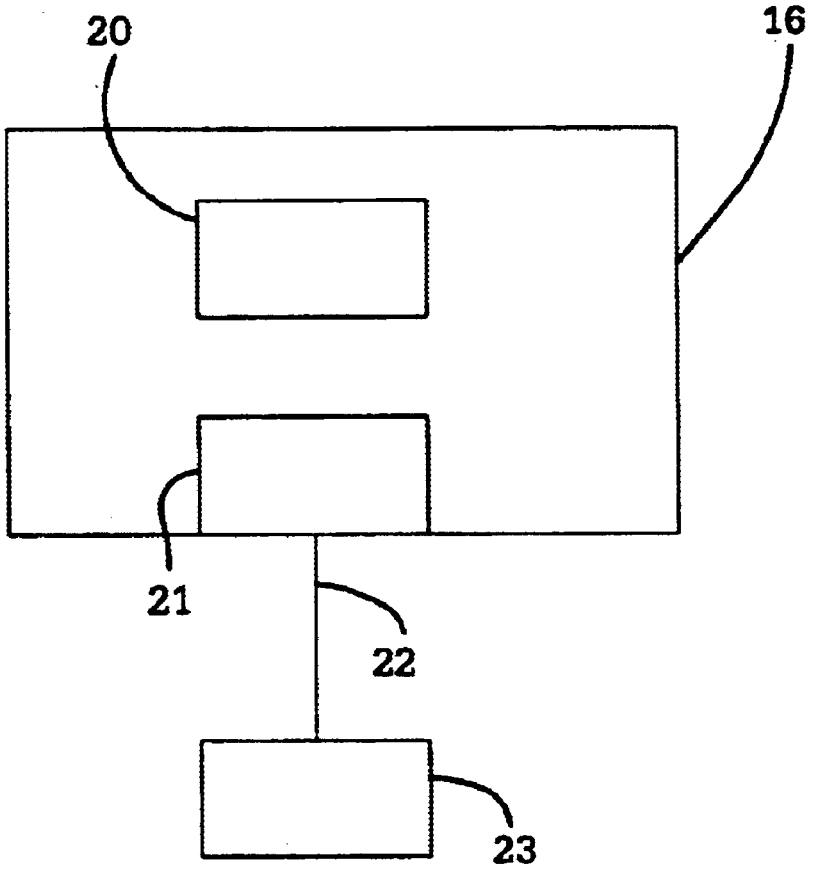
FIG. 4 is the diagram of a carriage including components mounted thereto.

The power operated drive means on or within the carriage comprises two drive wheels 18 which engage the two track portions 17, respectively, of the rail 10 and an electric motor 20 (FIG. 4) for driving the drive wheels 18.

The carriage 16 also comprises a flexible elongate support element 22 (FIG. 4) and power operated lifting means in the form of winch 21 within the carriage 16 for extending and retracting the support element relative to the carriage. A sling hanger 23 (FIG. 4) is attached to the lower free end of the support element which is suspended between the two track portions 17 of the rail 10.

Figure 2:
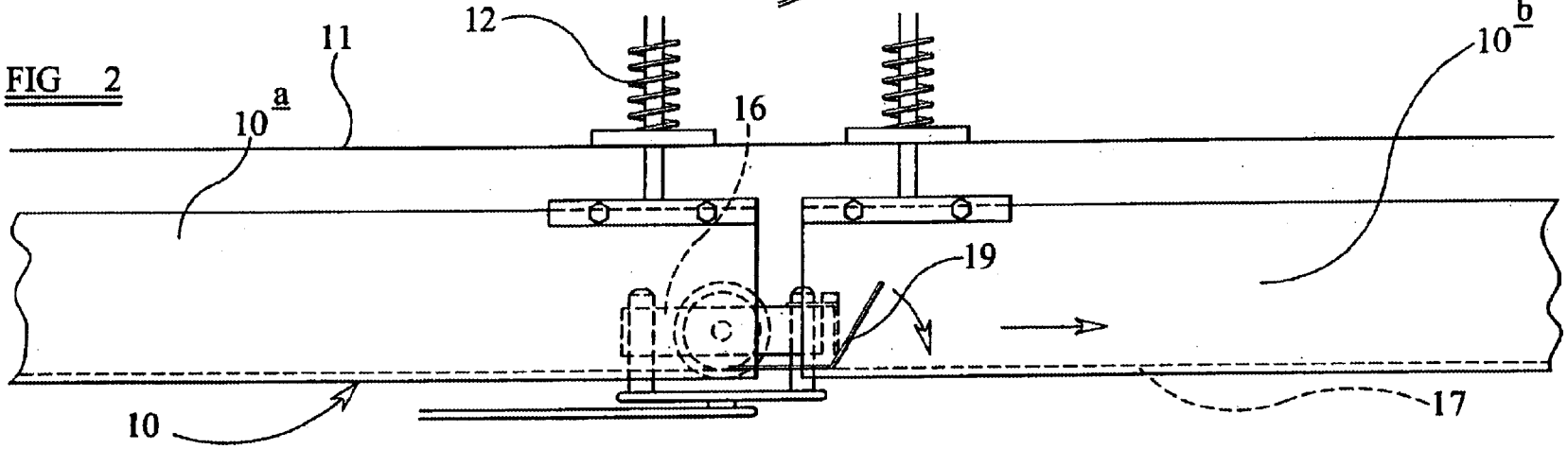
FIG. 2 is a schematic side view similar to FIG. 1, but showing the rail mounted patient lift in a second condition of operation.
Figure 3:
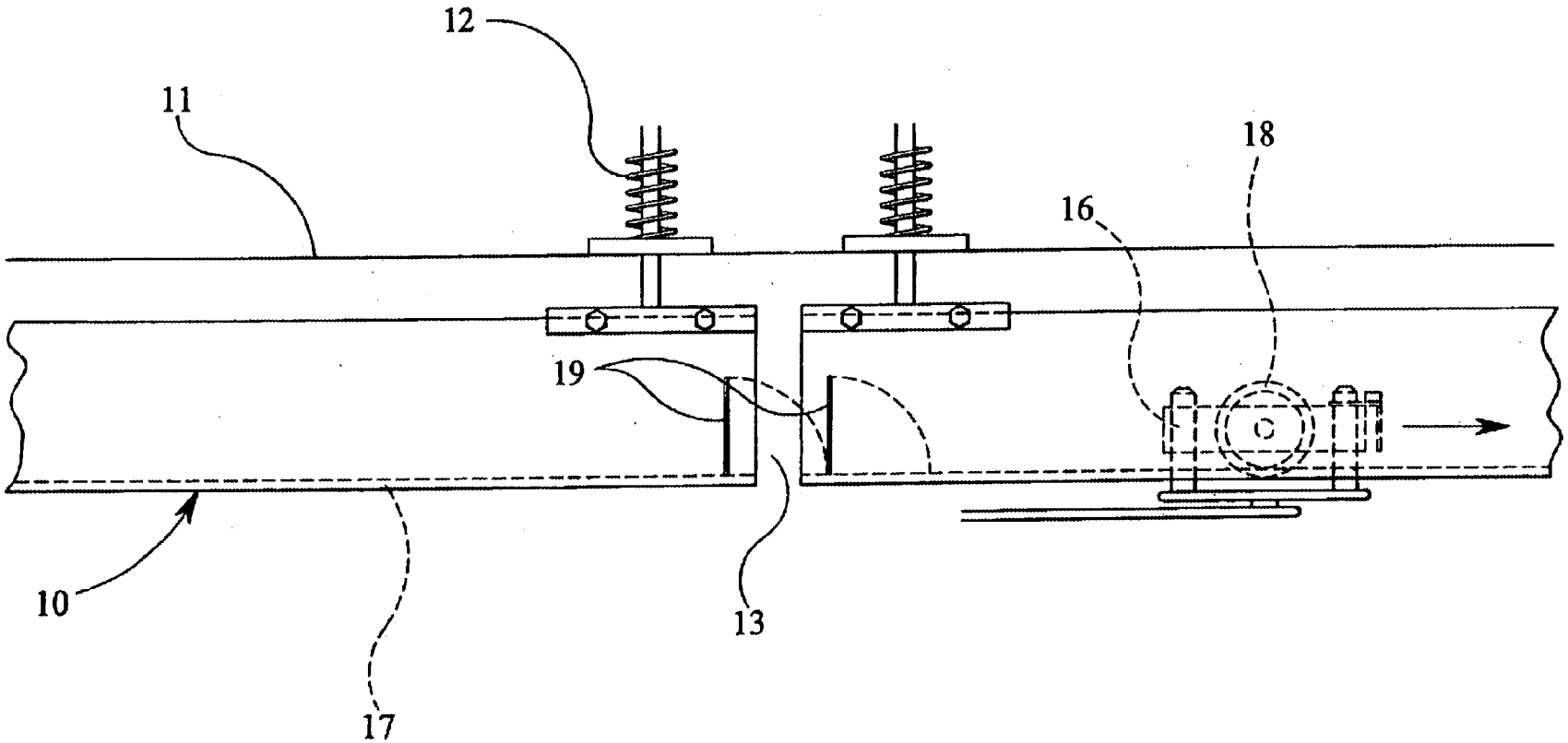
FIG. 3 is a schematic side view similar to FIGS. 1 and 2 but showing the rail mounted patient lift in a third condition of operation.

In order to allow the carriage 16 to bridge the gap 13 between the rail sections 10*a* and 10*b*, each rail section has two pivotable flaps 19 adjacent to its end. The two flaps 19 of each rail section 10*a*, 10*b* are pivotably mounted on respective track portions and are urged to generally upstanding positions, as shown in FIG. 1, by springs, typically in the form of torsion springs. The flaps 19 are each pivotable in opposite directions according to the direction of travel of the carriage 16. Thus, a carriage 16 moving from rail section 10*a* to rail section 10*b* (with the curtain undrawn) will engage the flaps 19 on the rail section 10*a* to pivot the flaps so that they bridge the gap 13 between the two rail sections 10*a* and 10*b* and the carriage will subsequently pivot the flaps on the rail section 10*b* so that these lie horizontally against their respective track portions 17 to enable the carriage 16 to pass by. FIG. 2 shows the flaps 19 of the rail section 10*a* bridging the gap 13 and the carriage 16 in contact with the flaps 19 of the rail section 10*b*. After the carriage 16 has passed by, the flaps 19 will return to generally upstanding positions as shown in FIG. 3. When the carriage 16 is travelling in an opposite direction the reverse will apply and the flaps 19 on the rail section 10*b* will bridge the gap 13.

In practice, the rail 10 will comprise more than two rail sections 10*a* and 10*b* with each rail section, apart from terminal sections, having flaps 19 adjacent to opposite ends of the rail section.

The embodiment described above is given by way of example only and various modifications will be apparent to persons skilled in the art without departing from the scope of the invention as defined by the appended claims. For example, the rail may be of alternative cross-sectional shapes and may provide only a single track portion for guiding the carriage along the rail. Each rail will then have only one flap at one or each end.

What is claimed is:

1. A rail mounted patient lift comprises a ceiling mountable rail, a carriage mounted for displacement along the rail, a flexible elongate support element and power operated lifting means for extending and retracting the support element relative to the carriage, wherein the rail comprises a plurality of rail sections which in use are suspended from a ceiling with a gap therebetween at a position where the rail is to cross the path of a curtain and wherein each rail section has at least one pivotable flap engageable by the carriage as it moves along the rail, the flap of one of a pair of adjoining rail sections being pivotable by the carriage as it moves in one direction to bridge the gap between the two sections and the flap of the other of the pair of adjoining rail sections being pivotable by the carriage as it moves in an opposite direction to bridge the gap between the two rail sections.

2. A rail mounted patient lift as claimed claim 1, wherein the flaps are urged to generally in use upstanding positions by spring means.

3. A rail mounted patient lift as claimed in claim 1, wherein each rail section has two parallel track portions for guiding the carriage and wherein each of the two track portions of each rail section has a pivotable flap.

4. A rail mounted patient lift as claimed in claim 1, further comprising power operated drive means on or within the carriage for displacing the carriage along the rail.

5. A rail mounted patient lift as claimed in claim 1, further comprising a sling hanger attached to the free end of the flexible elongate support element.

* * * * *